US006287054B1

(12) United States Patent
Egan et al.

(10) Patent No.: US 6,287,054 B1
(45) Date of Patent: Sep. 11, 2001

(54) PLANTABLE WALL BLOCK ASSEMBLY AND RETAINING WALL FORMED THEREFROM

(75) Inventors: Philip D. Egan, Atlanta; Augusto Bazzocchi, Dunwoody; Philip M. Taylor, Atlanta, all of GA (US)

(73) Assignee: Atlantech International Inc., Atlanta, GA (US)

( * ) Notice: Subject to any disclaimer, the term of this patent is extended or adjusted under 35 U.S.C. 154(b) by 0 days.

(21) Appl. No.: 09/572,311

(22) Filed: May 18, 2000

(51) Int. Cl.[7] ..... E02D 29/02

(52) U.S. Cl. ..... 405/262; 405/284; 405/286; 52/603; 52/604

(58) Field of Search ..... 405/262, 284, 405/285, 286; 52/603, 604, 606, 607

(56) References Cited

U.S. PATENT DOCUMENTS

| | | | | |
|---|---|---|---|---|
| 4,470,728 | | 9/1984 | Broadbent | 405/284 |
| 4,671,706 | | 6/1987 | Giardini | 405/286 |
| 4,914,876 | | 4/1990 | Forsberg | 52/169.4 |
| 4,998,397 | * | 3/1991 | Orton | 405/286 |
| 5,248,226 | * | 9/1993 | Risi et al. | 405/284 |
| 5,257,880 | * | 11/1993 | Janopaul, Jr. | 405/284 |
| 5,511,910 | * | 4/1996 | Scales | 405/262 |
| 5,540,525 | | 7/1996 | Miller et al. | 405/284 |
| 5,564,865 | | 10/1996 | Jansson | 405/286 |
| 5,568,998 | | 10/1996 | Egan et al. | 405/262 |
| 5,568,999 | | 10/1996 | Egan et al. | 405/262 |
| 5,595,460 | | 1/1997 | Miller et al. | 405/284 |
| 5,601,384 | | 2/1997 | Dawson | 405/284 |
| 5,619,835 | | 4/1997 | Bailey, II et al. | 52/606 |
| 5,620,283 | * | 4/1997 | Walter | 405/286 |
| 5,673,530 | | 10/1997 | Bailey, II | 52/606 |
| 5,816,749 | | 10/1998 | Bailey, II | 405/286 |
| 5,820,305 | * | 10/1998 | Taylor et al. | 405/286 |
| 5,851,088 | | 12/1998 | Anderson et al. | 405/284 |
| 5,911,539 | | 6/1999 | Egan et al. | 405/20 |
| 5,934,838 | | 8/1999 | Egan | 405/262 |
| 6,019,550 | * | 2/2000 | Wrigley et al. | 405/262 |

* cited by examiner

*Primary Examiner*—David Bagnell
*Assistant Examiner*—Frederick L. Lagman
(74) *Attorney, Agent, or Firm*—Jacobson Holman, PLLC

(57) ABSTRACT

Concrete blocks are used to build plantable retaining walls having varying angles. The blocks have a hollow inner volume, open at the top and bottom to enable the plants to grow therein. The side walls of the block each have a portion which is parallel to the longitudinal axial vertical center plane of the block. The parallel portions of the side walls include a plurality of connector-receivers to allow for the interconnection of one block with superimposed blocks at varying staggering positions by the engagement of discrete connector devices. The blocks may be interconnected to geogrids for the construction of reinforced retaining walls. The connection to the geogrids may be made using the same connector connecting the blocks or a distant one.

26 Claims, 5 Drawing Sheets

PLANTABLE WALL BLOCK ASSEMBLY AND RETAINING WALL FORMED THEREFROM

BACKGROUND OF THE INVENTION

1. Field of the Invention

This invention relates to a plantable wall block assembly comprising a plurality of modular wall blocks with connectors therefor, and retaining walls constructed therewith including geogrid reinforcing sheet material, where necessary.

2. Description of the Prior Art

Modular wall block assemblies for construction of retaining walls are frequently used for architectural and site development applications. Since the wall facing must sometimes withstand very high pressures exerted by backfill soils, reinforcement and stabilization of the soil backfill is commonly provided by grid-like sheet materials, known as geogrids, that are placed in layers in the soil fill behind the wall face to interlock with the fill and create a stable reinforced soil mass. Connection of the reinforcing materials to the elements forming the wall holds the wall and elements in place and resists soil backfill pressures.

Superimposed courses of wall blocks are staggered laterally to facilitate interlocking superior wall blocks with those they overly. Many modular wall block assemblies are provided with means to adjust the stepped-back relationship of superior courses to enable the walls to be constructed with the front faces of the wall blocks vertically aligned or set back to angle the relationship of the wall to the foundation.

Often times, it is desired to provide plant-receiving cavities in the forward portions of modular wall blocks for aesthetic purposes and/or to minimize erosion of the soil fill material. One example of a plantable wall block is seen in Dawson U.S. Pat. No. 5,601,384 wherein the design of the block enables limited selectivity in set-back with the principal plant-receiving cavities being provided by the laterally staggered nature of the blocks in superimposed courses.

An earlier version of a retaining wall formed from a plantable wall block is seen in Giardini U.S. Pat. No. 4,671,706 wherein the blocks are stepped-back by the selective engagement of a depending flange on the front wall of superior blocks in one of a plurality of spaced notches in the side walls of inferior blocks. Blocks of this nature are difficult to store because the flanges are easily broken, limiting the usefulness of such a system.

The plantable wall block assembly seen in Jansson U.S. Pat. No. 5,564,865 relies on an elongated tensioning member passing through blocks in the various courses to tie the wall together, an obvious tedious and difficult construction. While Jansson does provide for means to secure a geogrid to the retaining wall, the connection relies solely on the weight of superimposed wall blocks, a construction particularly subject to damage during a seismic event, such as an earthquake, or the like. Miller et al U.S. Pat. Nos. 5,564,525 and 5,595,460 show comb-like connectors adapted to mechanically interlock geogrid or the like to selected modular wall block to preclude such problems.

SUMMARY OF THE INVENTION

It is a primary object of this instant invention to provide a plantable wall block assembly and retaining walls constructed therefrom which do not rely principally on the blocks themselves for interlocking engagement between portions of blocks in superimposed staggered courses, nor does it rely principally on the blocks themselves to provide means for securing geogrid or other tie-back sheets to the retaining wall in a positive manner.

A further object of this invention is the provision of a plantable wall block assembly which comprises both cementitious wall blocks and discrete connector elements to selectively secure wall blocks to each other in a plantable retaining wall with the angle of the retaining wall relative to the foundation adjustable to meet specific requirements.

Yet another object of this invention is the provision of a plantable wall block assembly wherein plant-receiving cavities are incorporated in the forward portions of the blocks so that, when a retaining wall is formed therefrom, plants may be used to decorate and strengthen the retaining wall against erosion.

The foregoing and other such advantages are provided with the plantable wall blocks of this invention which have generally open top and bottom surfaces with a hollow void between them, suitable for the construction of reinforced and unreinforced retaining walls while allowing for the growth of plants carried by the blocks. Various complementary connectors and connector-receiving means are provided to allow for the selectable relative positioning of superimposed blocks, interconnected by the connectors in a variety of staggered positions to permit the retaining wall to have various set-back angles using the same block design.

The preferred modular wall block of this invention is formed by a front wall, two side walls and a rear wall, major portions of the front and the rear walls being generally parallel and portions of the side walls also being generally parallel to each other and to the block central axial vertical plane. All walls are upright include top and bottom surfaces which are generally parallel, even though certain portions of these surfaces may advantageously lay on different planes.

It has been found advantageous to place connectors on portions of the side walls of the blocks which are parallel to each other and to the axial vertical center plane of the block so that the blocks of different courses may be positioned at varying staggering positions without having to use blocks having different designs for each different set-back angle. Thus, each lateral or side wall of the block has parallel intermediate portions which preferably extend for substantially the same length, or, at least, have the same or substantially the same working length.

In one embodiment of this invention, these portions of the side walls include transverse, horizontally-extending recesses adapted to receive portions of connecting devices which may be used to secure geogrid to the blocks and which also provide a basic point for selectively locating a pair of staggered superimposed blocks at a given set-back angle. It is to be understood, however, that it is within the scope of this invention for the devices connecting the grid to the block and the devices connecting the blocks to each other to be different.

Another form of connecting means is more like a saddle and interengages with one of two or more pairs of vertically-extending slots or grooves formed on the inside and outside of the parallel portions of the wall block side walls to enable the blocks in succeeding courses to be selectively stepped-back from blocks which they overly.

From the description of the block of this invention it will be readily appreciated that the unique features which characterize this block allow for the construction of a wide variety of plantable walls using one block structure and that the block described herein is optimised by way of its weight, placement in use and construction features.

Further objects and advantages of the instant invention will become apparent to those skilled in the art from the accompanying drawings and detailed description of the preferred embodiments.

DETAILED DESCRIPTION OF THE PREFERRED EMBODIMENTS

Figure 1:
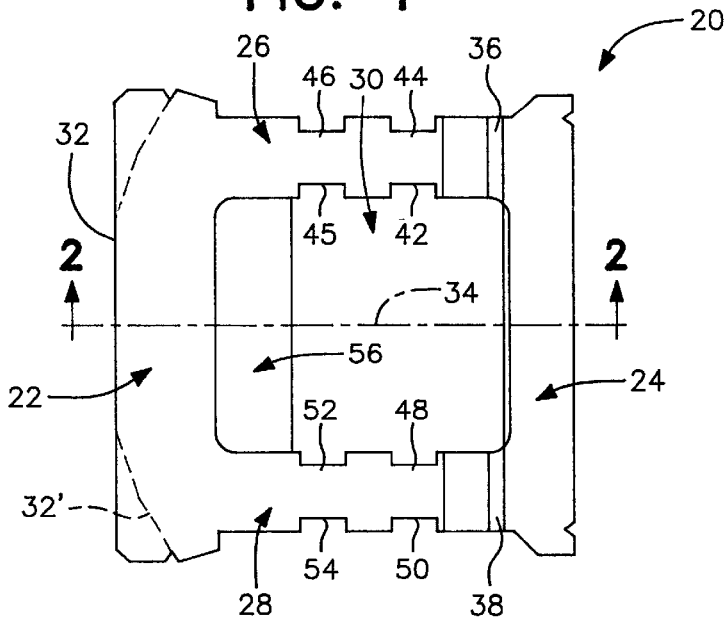
FIG. 1 is a top plan view of one embodiment of a plantable modular wall block according to the instant inventive concepts, the dotted lines designating an alternate face structure.
Figure 2:
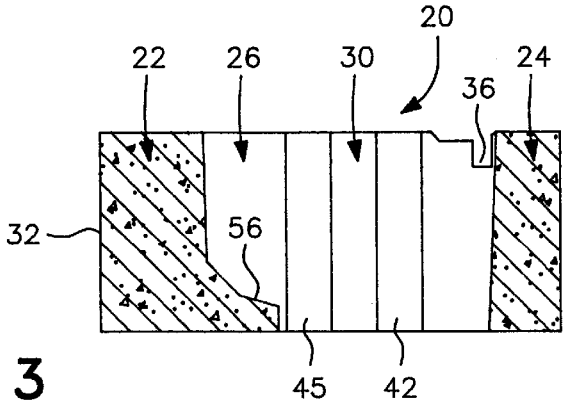
FIG. 2 is a vertical cross-sectional view taken along line 2—2 of FIG. 1.

Referring now to the drawings, and more particularly to FIGS. 1 and 2, the first embodiment of a plantable wall block according to the instant inventive concepts is designated generally by the reference numeral 20 and comprises basically a front wall 22, a rear wall 24 and a pair of opposing side walls 26, 28, each of which includes an inside face, an outside face, a top surface and a bottom surface. An enlarged opening 30 extends between at least portions of the top and bottom surfaces of the walls and is defined by the inside faces of the walls 22, 24, 26 and 28.

The wall blocks 20 are generally formed of cementitious material in a well known manner, although the specific nature of the composition of the wall blocks or the method of manufacturing same are not an integral part of the instant inventive concepts.

The front faces 32 of the front walls 22 of the individual wall blocks 20 may take various forms. When a plurality of blocks are interconnected as described below to form a retaining wall, as seem for example, in FIG. 12 at 100, the front faces of the wall blocks together define the front face of the retaining wall. Thus, the front face 32 of the block 20 can be flat as shown in full lines in FIG. 1 or, alternatively, can be faceted as shown by the dotted lines 32' in FIG. 1 and as seen in some of the other embodiments.

Portions of the front and rear walls 22, 24 are generally parallel to each other as seen, and at least intermediate portions of the side walls 26, 28 are generally parallel to each other and to a longitudinally extending wall block vertical central plane which includes the axis 34.

The wall blocks of this invention are designed for use with one of a variety of connectors described in more detail below with particular reference to FIGS. 7–9. Depending upon the manner in which the wall blocks are to be used, the selected connector devices can be different and the wall block construction adapted to cooperate with the connectors can also be different.

Regardless of the particular embodiment of wall block as described herein, the top and bottom surfaces of the intermediate or parallel portions of the side walls are always provided with a plurality of connector-receiving means, some of which may be the same and others of which may be different. For example, in the embodiment of FIGS. 1 and 2, first horizontally extending, connector-receiving slots 36, 38 are defined in the top surfaces of side walls 26, 28, respectively. The first connector-receiving slots 36, 38 are aligned with each other and extend transversely to the wall block central vertical plane including axis 34 for reception of a connector device of the type illustrated in FIG. 8 or FIG. 9 as will be discussed further hereinbelow.

In addition to the slots 36, 38, the wall block 20 also includes pairs of longitudinally spaced, vertically extending, connector-receiving grooves defined in the inside and outside faces, respectively, of the intermediate portions of the side walls 26, 28, two such pairs of grooves 42, 44 and 45, 46 being provided in side wall 26 and two such pairs of grooves, 48, 50 and 52, 54 being provided in side wall 28. The upper portions of these connector-receiving grooves are designed to cooperate with the lower portions of a connector of the type illustrated, for example, in FIG. 7 as will be described below and the lower portions of these grooves being adapted to cooperate either with the upper portions of connectors of the type illustrated in FIG. 7, or the upper portions of connectors such as illustrated in FIG. 8 or FIG. 9.

A ledge or shelf 56 underlies the forward portions of the opening 30 in the wall block 20 to facilitate retaining soil or the like in a plant-receiving cavity formed by the block 20 as discussed below with respect particularly to FIGS. 10–13.

Figure 3:
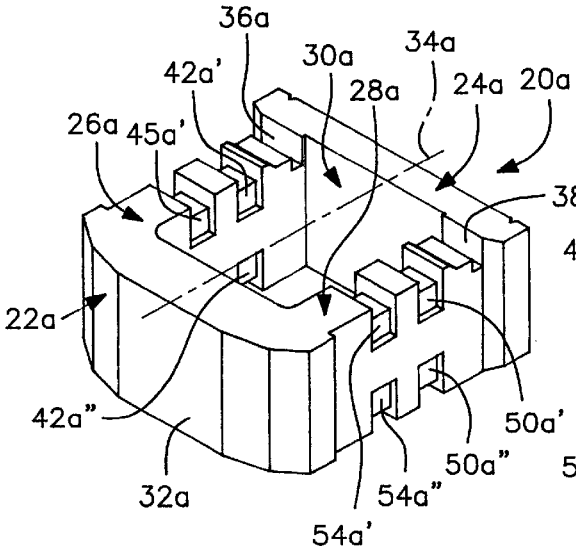
FIG. 3 is a perspective view of a modified plantable wall block according to this invention.
Figure 4:
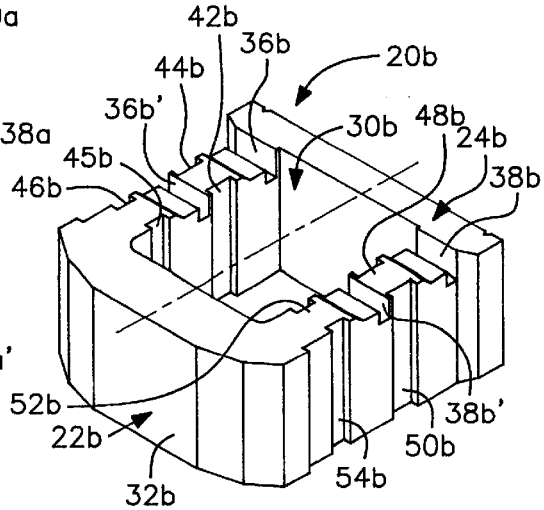
FIG. 4 is a perspective view of yet a further modified plantable wall block.
Figure 5:
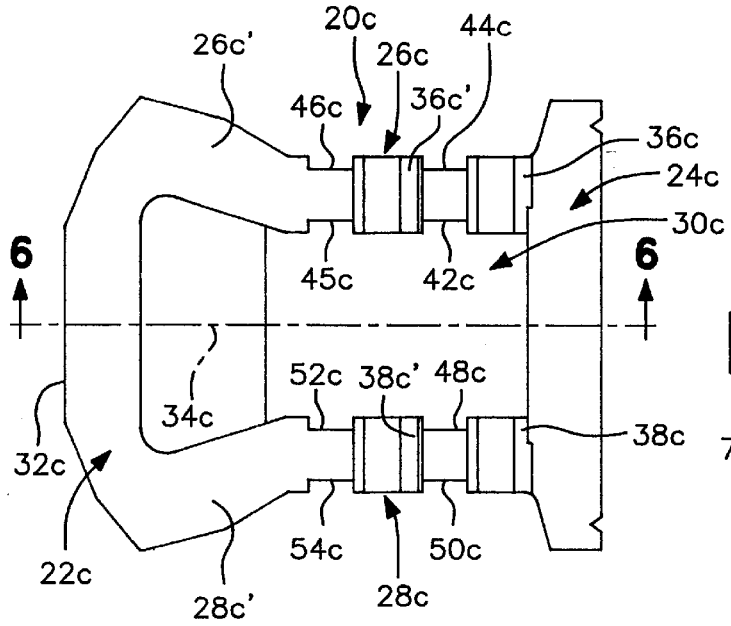
FIG. 5 is a top plan view of another embodiment of plantable modular wall block according to this invention.

FIGS. 3–5 illustrate alternate embodiments of wall blocks according to the instant inventive concepts. Since, for the most part, the wall blocks in these Figures are similar to the wall block 20 in FIG. 1, they will be designated by the same reference numerals followed by the suffix "a" for the FIG. 3 embodiment, "b" for the FIG. 4 embodiment and "c" for the embodiment of FIGS. 5 and 6.

The basic distinction between the wall block 20*a* in FIG. 3 and the wall block 20 in FIGS. 1 and 2 resides in the formation of the vertically-extending connector-receiving grooves. The grooves are interrupted in the FIG. 3 embodiment, i.e., they do not extend continuously from the top surface to the bottom surface, and, additionally, the top and bottom surfaces are recessed to accommodate spine portions of the connectors as discussed below. Thus, upper connector-receiving grooves 42*a*'–54*a*' and lower connector-receiving grooves 42*a*"–54*a*" are formed in the block 20*a*.

In the FIG. 4 embodiment, a second pair of horizontally-ending connector-receiving slots designated as 36*b*' and 38*b*' are provided.

Figure 6:
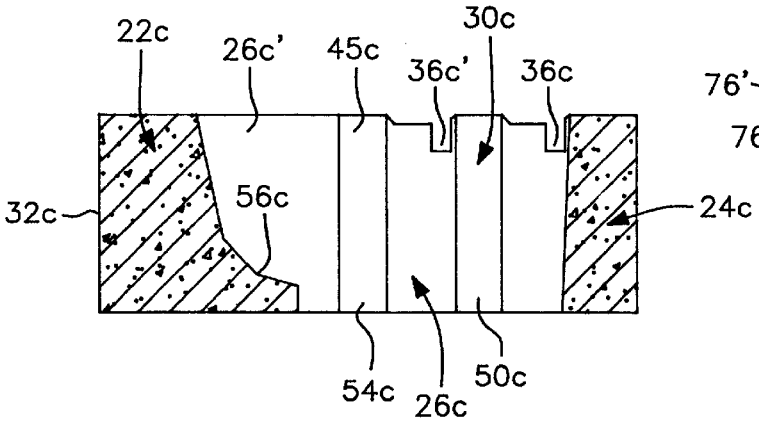
FIG. 6 is a vertical cross-sectional elevational view taken along line 6—6 of FIG. 5.

The embodiment of FIGS. 5 and 6 not only has two pairs of horizontally-extending connector-receiving slots 36*c*, 38*c* and 36*c*', 38*c*', and two pairs of vertically extending grooves 42*c*–54*c*, but also has a significantly different shape in the side walls 26*c*, 28*c* which include diverging portions 26*c*' and 28*c*' interconnecting the intermediate parallel portions of the side walls with the front wall 22*c*. This latter embodiment is included to merely illustrate the relative unimportance of the shape of the wall blocks of this invention, except for the large central plant-receiving cavities and the parallel intermediate portions of the side walls which incorporate the various connector-receiving slots/grooves. This basic construction enables wall blocks in a plurality of superimposed courses of wall blocks to be selectively stepped-back from an orientation in which the front faces of wall blocks in succeeding courses of wall blocks are vertically aligned to an orientation where the wall can be angled significantly from the bottom toward the top in various increments.

Figure 7:
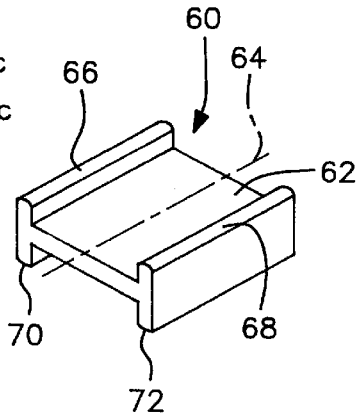
FIG. 7 is a perspective view of one form of connector device for use with the plantable modular wall blocks of this invention.
Figure 8:
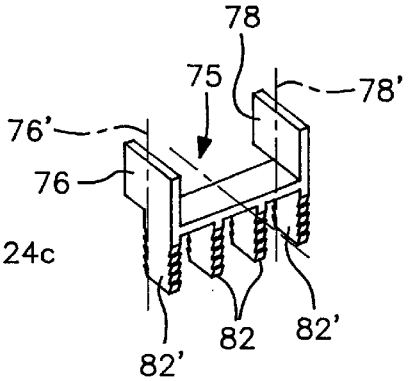
FIG. 8 is a perspective view of a second embodiment of connector device.
Figure 9:
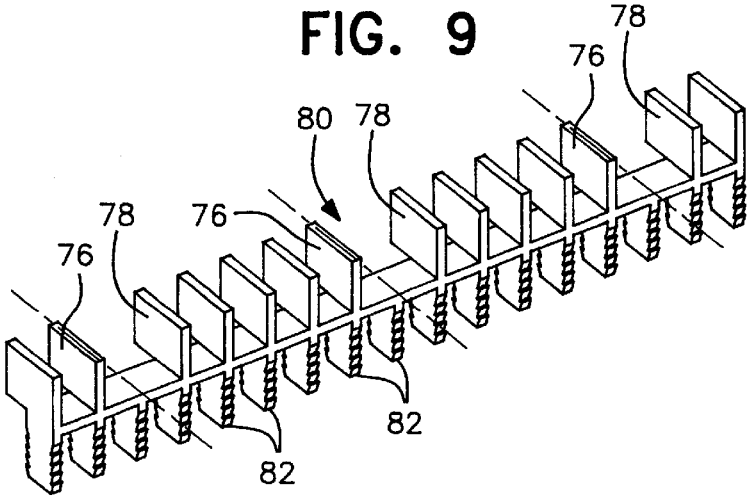
FIG. 9 is a perspective view of yet another embodiment of connector device for use with the plantable modular wall block of this invention.

As noted, various connector devices may be provided according to the instant inventive concepts, three such devices being illustrated in FIGS. 7–9. The connector device 60 illustrated in FIG. 7 is basically H-shaped comprising a spine 62 having opposed top and bottom surfaces and opposed end portions, with a connector vertical central plane, including extending between the end portions. A pair of laterally spaced first integral protrusions 66, 68, extend from the top surface of the spine and a pair of further integral protrusions 70, 72 extend from the bottom surface of the spine. In this instance, the upper protrusions 66, 68 are a continuation of the lower protrusions 70, 72 on the opposite surface of the spine 62. The spacing between the protrusion 66 and 68 and 70 and 72, respectively, is dimensioned to enable one pair of protrusions to be slidingly received in a selected pair of vertically extending grooves 42, 44 or, 45, 46 or, 48, 50 or 52, 54 on the top of side walls 26, 28, with the opposing pair of protrusions received in the lower portions of such connector-receiving slots in a superimposed block to thereby interconnect the blocks with the front faces of blocks in succeeding courses of wall blocks selectively stepped-back with respect to each other in a manner to be disclosed below.

The alternate forms of connectors, 75 shown in FIG. 8 and 80 shown in FIG. 9, each have a plurality of downwardly extending first protrusions or fingers 82 dimensioned to be frictionally engaged in one of the horizontally-extending connector-receiving slots 36, 38. The connector 80 actually spans an entire wall block with fingers 82 on opposed end portions being simultaneously engaged in slots 36 and 38 on opposite side walls 26, 28.

Upwardly extending protrusions or tabs 76, 78 are spaced apart in a manner similar to the protrusions 66, 68 and 70, 72 of the connector 60 of FIG. 7 so as to span a side wall 26 or 28 of a block 20 to be slidingly received in the lower portions of selected vertically-extending grooves 42, 44 or 45, 46 or 48, 50 or 52, 54 in a similar manner.

Figure 10:
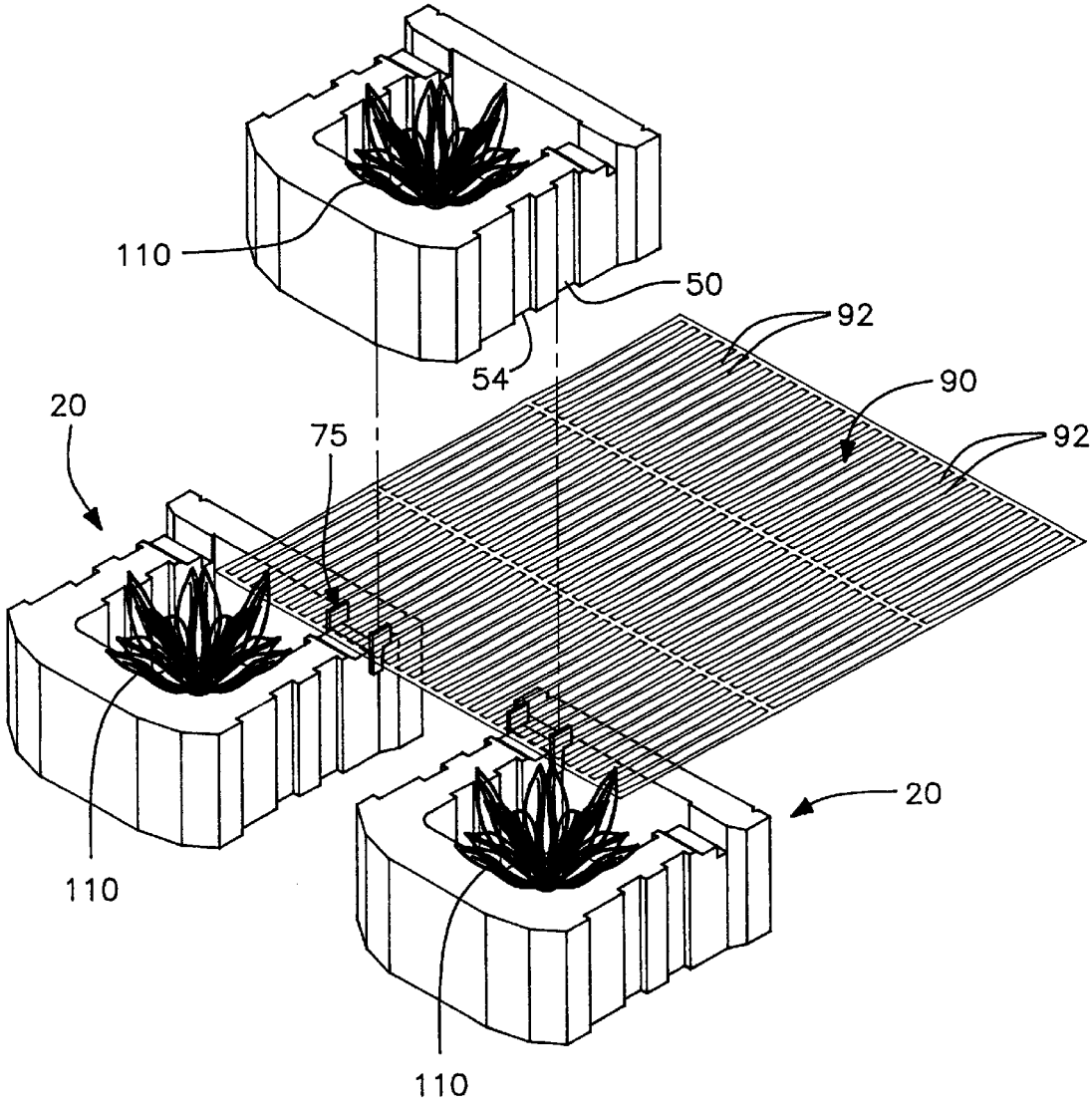
FIG. 10 is an exploded view showing one way of interconnecting the modular wall blocks of FIGS. 1 and 2 using connector elements such as shown in FIG. 8 to secure a geogrid thereto and position the front faces of wall blocks in superimposed courses with respect to each other.
Figure 11:
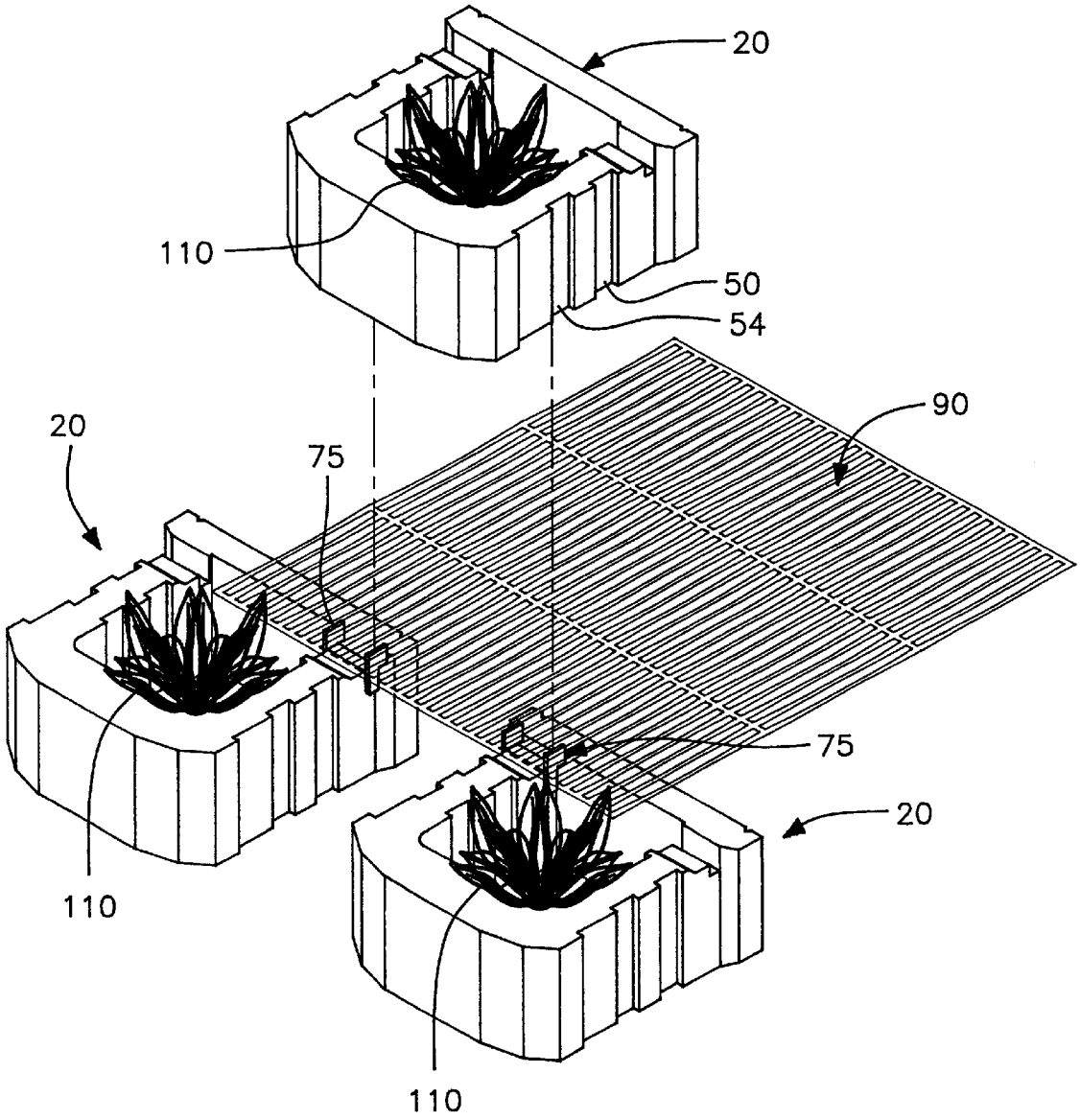
FIG. 11 is view similar to FIG. 10, but showing the use of an alternate positioning of the superimposed wall blocks to vary the setback of the courses with respect to each other.
Figure 12:
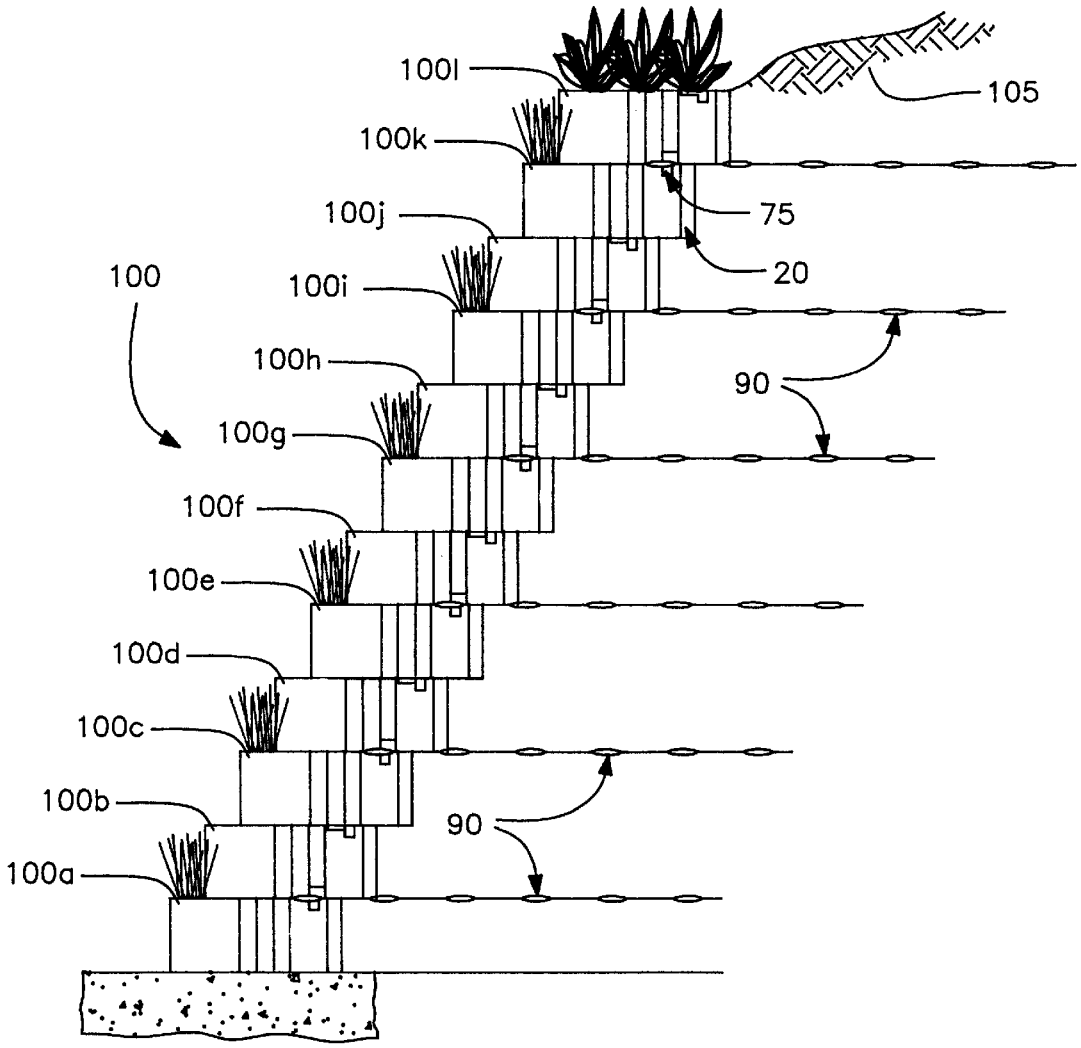
FIG. 12 is a schematic side elevational view showing a planted retaining wall formed with the modular wall blocks of the instant invention and reinforced by multiple layers of geogrid.

The downwardly extending fingers 82 in the connector 75 and 80 of FIGS. 8 and 9 are particularly adapted to secure end portion of a geogrid reinforcing sheet material such as illustrated at 90 in FIGS. 10–12 to the wall blocks, the spacing between fingers 82 complementing the spacing between the apertures 92 in the geogrid 90.

Referring now to FIGS. 10–12, a retaining wall such as shown at 100 is constructed by forming a multiplicity of superimposed courses of wall blocks 20, shown at 100*a*–100*l* in FIG. 12, a sheet of geogrid reinforcing material 90 being secured to one or more pairs of spaced blocks 20 by individual connectors such as shown at 75 in FIGS. 10 and 11. Superimposed blocks 20 are commonly laterally staggered with respect to the underlying blocks as seen and may be located in a set-back position by engaging the upwardly tending protrusion 76, 78 on the connectors 75 in selected vertically extending grooves on the blocks in a superior course. In FIG. 10, the connectors 75 are engaged in the rearward pairs of vertically-extending connector-receiving grooves 42, 44 and 48, 50 to provide one level of set-back, whereas in FIG. 11, the connectors 75 are engaged in the forward pairs of vertically-extending connector-receiving grooves 45, 46 and 52, 54 to increase the angle of the resultant retaining wall.

In addition to engaging the tabs 76, 78 in selected vertically-extending grooves, the connectors 75 or 80 can be rotated by 180° to provide even more options in the angle of the set-back of the retaining wall 100. Since the vertical center lines 82' of the fingers 82 and the vertical center lines 76', 78' of the tabs 76, 78 are offset from each other, reversing the connectors provides a further variation in the set-back in successive courses of wall blocks.

Geogrid reinforcing sheets 90 can be positioned between selected courses of wall blocks, extending rearwardly into the fill material 105 behind the retaining wall 100 to reinforce the same.

Figure 13:
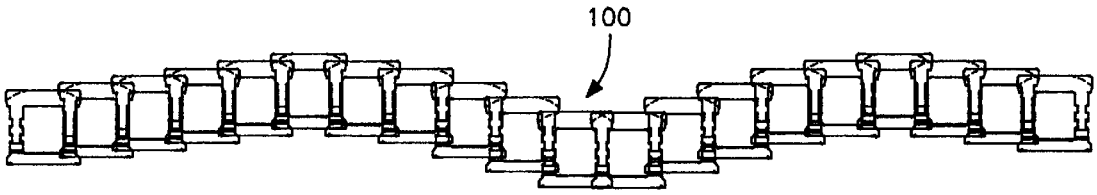
FIG. 13 is a schematic top plan view showing the way in which such blocks can be interrelated with each other to form "curved" sections of retaining wall therefrom.

As seen in FIG. 13, the manner in which the wall blocks are interengaged can be such as to provide virtual curvature to the retaining wall by carefully selecting the particular connector-receiving slots as the wall blocks are assembled to form the retaining wall.

It is to be understood that an individual retaining wall can be formed using various embodiments of the wall blocks themselves and various connectors in the same wall, depending upon the intended application. More preferably, however, the assembly can include a multiplicity of wall blocks of the same construction to minimize the inventory of these cumbersome elements necessary to construct a retaining wall of great versatility and varying set-back depending upon the terrain.

Additionally, because the unique nature of the wall blocks of this invention, the forward portions of wall blocks in inferior courses define cavities for the reception of plants such as shown at 110 in FIGS. 10–12 to improve the aesthetics of the retaining wall and minimize erosion of soil or other aggregate used in forming the wall.

It will now be seen that the plantable wall block assembly of the instant inventive concepts, comprising basically a plurality of individual wall blocks in combination with a plurality of individual connectors and, if desired, geogrid reinforcing sheet material, enables the efficient construction of a plantable retaining wall having a selected set-back with minimal need for extraneous tools other than, perhaps, a mallet to drive the downwardly extending fingers 82 of connectors such as seen at 75 or 80 in FIGS. 8 and 9 into the horizontally-extending connector-receiving slots 36, 38 if a geogrid is to be incorporated into the wall.

While preferred embodiments of the instant invention have been described and illustrated herein, it will be clear that variations of the details of construction which are specifically shown and described may be resorted to without departing from the true spirit and scope of the invention as defined in the appended claims.

What is claimed is:

1. A plantable wall block assembly comprising a plurality of modular wall blocks and a plurality of connectors therefor, each of said wall blocks including a front wall, a rear wall and a pair of opposing side walls, each of said wall including an inside face, an outside face, a top surface and a bottom surface, an opening extending between at least portions of said top and bottom surfaces of said walls and defined by said inside faces thereof, said front and rear walls each having opposed end portions and intermediate portions which are generally parallel to each other, and each of said side walls each having opposed front and rear portions and intermediate portions which are generally parallel to each other and to a wall block vertical central axial plane which is perpendicular to said intermediate portions of said front wall, at least one first connector-receiving slot defined in one of said top and bottom surfaces of said intermediate portions of each of said side walls, and at least two further connector-receiving slots defined in spaced relationship to each other in the other of said top and bottom surfaces, each of said connectors including a spine having opposed top and bottom surfaces and opposed end portions with a connector vertical central axial plane extending between said end portions, at least one first integral protrusion extending from one of said top and bottom surfaces of said spine adapted for engagement in said first connector-receiving slot of one of said wall blocks and at least one further integral protrusion extending from the other of said top and bottom surfaces of said spine adapted for selective engagement in one of said further connector-receiving slots of another of said wall blocks, whereby said connectors are adapted to interconnect wall blocks in superimposed courses of wall blocks with the outside faces of the front walls of wall blocks in superior courses selectively positioned in one of at least two orientations with respect to the outside faces of the front walls of wall blocks in an inferior course of wall blocks which they overly with forward portions of openings in wall blocks in inferior courses of a retaining wall selectively extending forwardly of the outside faces of the front walls of wall blocks in the next superior course to define plant-receiving cavities.

2. A plantable wall block assembly according to claim 1 wherein each of said first connector-receiving slots is defined in said top surface of said intermediate portion of each of said side walls of said wall blocks and extends transversely to said wall block vertical central axial plane, and each of said first protrusions on said connectors extends from said bottom source of said spine and is dimensioned for frictional engagement in said first connector-receiving slots.

3. A plantable wall block assembly according to claim 2 further including geogrid reinforcing sheet material having end portions defining a multiplicity of spaced apertures, each of said connectors comprising a plurality of first protrusions spaced from each other so as to pass through selected apertures of said geogrid sheet material to secure said end portions of said geogrid sheet material to selected wall blocks with the remainder of said geogrid sheet material extending therefrom to reinforce fill material behind a retaining wall formed from said wall blocks.

4. A plantable wall block assembly according to claim 3 wherein said first connector-receiving slots in intermediate portions of opposed side walls of each wall block are transversely aligned with each other and said spines of said connectors are dimensioned to extend across said wall block with first protrusions thereof extending from opposed end portions of said spine through apertures in said geogrid sheet material for frictional engagement in said aligned first connector-receiving slots, and with additional first protrusions intermediate said opposed end portions of said spine for passing through additional apertures in said geogrid sheet material.

5. A plantable wall block assembly comprising a plurality of modular wall blocks and a plurality of connectors therefor, each of said wall blocks including a front wall, a rear wall and a pair of opposing side walls, each of said walls including an inside face, an outside face, a top surface and a bottom surface, an opening extending between at least portions of said top and bottom surfaces of said walls and defined by said inside faces thereof, said front and rear walls each having opposed end portions and intermediate portions which are generally parallel to each other, and each of said side walls each having opposed front and rear portions and intermediate portions which are generally parallel to each other and to a wall block vertical central axial plane which is perpendicular to said intermediate portions of said front wall, at least one first connector-receiving slot defined in one of said top and bottom surfaces of said intermediate portions of each of said side walls, and at least two further connector-receiving slots defined in spaced relationship to each other in the other of said top and bottom surfaces, each of said connectors including a spine having opposed top and bottom surfaces and opposed end portions with a connector vertical central axial plane extending between said end portions, at least one first integral protrusion extending from one of said top and bottom surfaces of said spine adapted for engagement in said first connector-receiving slot of one of said wall blocks and at least one further integral protrusion extending from the other of said top and bottom surfaces of said spine adapted for selective engagement in one of said further connector-receiving slots of another of said wall blocks, whereby said connectors are adapted to interconnect wall blocks in superimposed courses of wall blocks with the outside faces of the front walls of wall blocks in superior courses selectively positioned in one of at least two orientations with respect to the outside faces of the front walls of wall blocks in an inferior course of wall blocks which they overly with forward portions of openings in wall blocks in inferior courses of a retaining wall selectively extending forwardly of the outside faces of the front walls of wall blocks in the next superior course to define plant-receiving cavities, each of said first connector-receiving slots being defined in said top surface of said intermediate portion of each of said side walls of said wall blocks and extending transversely to said wall block vertical central axial plane, and each of said first protrusions on said connectors extending from said bottom surface of said spine and being dimensioned for frictional engagement in said first connector-receiving slots, and wherein each of said further connector-receiving slots includes grooves defined in opposed faces of said intermediate portions of each of said side walls of said wall blocks, said grooves extending at least partially up said side walls from said bottom surface thereof, each of said further protrusions on said connectors comprising at least one pair of protrusions extending from said top surface of said spine spaced from each other along said connector vertical central axial plane so as to be slidingly received in a selected pair of grooves.

6. A plantable wall block assembly according to claim 5 wherein said first protrusions have a vertical center line, said second protrusions have a vertical center line, and said center lines of said first and second protrusions are offset from each other.

7. A plantable wall block assembly according to claim 5 further including geogrid reinforcing sheet material having end portions defining a multiplicity of spaced apertures, each of said connectors comprising a plurality of first projections spaced from each other so as to pass through selected apertures of said geogrid sheet material to secure said end portions of said geogrid sheet material to selected wall blocks with the remainder of said geogrid sheet material extending therefrom to reinforce fill material behind a retaining wall formed from said wall blocks.

8. A plantable wall block assembly according to claim 7 wherein said first connector-receiving slots in intermediate portions of opposed side walls of each wall block are transversely aligned with each other and said spines of said connectors are dimensioned to extend across said wall block with first protrusions thereof extending from opposed end portions of said spine through apertures in said geogrid sheet material for frictional engagement in said aligned first connector-receiving slots, and with additional first protrusions intermediate said opposed end portions of said spine for passing through additional apertures in said geogrid sheet material.

9. A plantable wall block assembly comprising a plurality of modular wall blocks and a plurality of connectors therefor, each of said wall blocks including a front wall, a rear wall and a pair of opposing side walls, each of said walls including an inside face, an outside face, a top surface and a bottom surface, an opening extending between at least portions of said top and bottom surfaces of said walls and defined by said inside faces thereof, said front and rear walls each having opposed end portions and intermediate portions which are generally parallel to each other, and each of said side walls each having opposed front and rear portions and intermediate portions which are generally parallel to each other and to a wall block vertical central axial plane which is perpendicular to said intermediate portions of said front wall, at least one first connector-receiving slot defined in one of said top and bottom surfaces of said intermediate portions of each of said side walls, and at least two further connector-receiving slots defined in spaced relationship to each other in the other of said top and bottom surfaces, each of said connectors including a spine having opposed top and bottom surfaces and opposed end portions with a connector vertical central axial plane extending between said end portions, at least one first integral protrusion extending from one of said top and bottom surfaces of said spine adapted for engagement in said first connector-receiving slot of one of said wall blocks and at least one further integral protrusion extending from the other of said top and bottom surfaces of said spine adapted for selective engagement in one of said further connector-receiving slots of another of said wall blocks, whereby said connectors are adapted to interconnect wall blocks in superimposed courses of wall blocks with the outside faces of the front walls of wall blocks in superior courses selectively positioned in one of at least two orientations with respect to the outside faces of the front walls of wall blocks in an inferior course of wall blocks which they overly with forward portions of openings in wall blocks in inferior courses of a retaining wall selectively extending forwardly of the outside faces of the front walls of wall blocks in the next superior course to define plant-receiving cavities, each of said first connector-receiving slots of said wall blocks including first grooves defined in opposite faces of said intermediate portions of each of said side walls, said grooves extending at least partially down said side walls from said top surface thereof, and each of said further connector-receiving slots including further grooves defined in opposite faces of said intermediate portions of each of said side walls, said further grooves extending at least partially up said side walls from said bottom surface thereof, each of said first protrusions on said connectors comprising at least one pair of protrusions extending from said bottom surface of said spine spaced from each other along said connector vertical axial plane so as to be slidingly received in a selected pair of said first grooves, and each of said further protrusions on said connector comprising at least one pair of protrusions extending from said top surface of said spine spaced from each other along said connector vertical central axial plane so as to be slidingly received in a selected pair of said further grooves.

10. A plantable wall block assembly according to claim 9 wherein each of connectors is generally H-shaped, the pair of protrusions forming said first protrusions being a continuation of the pair of protrusions forming said further protrusions on the opposite surface of the spine of said connector.

11. A plantable wall block assembly according to claim 9 wherein said first grooves and said further grooves are interconnected to form continuous grooves on opposite faces of said intermediate portions of each of said side walls of said wall blocks.

12. A plantable wall block assembly according to claim 9 wherein the portions of at least one of said top and bottom surfaces of said intermediate portions of said side walls of said wall blocks interconnecting said first grooves and said further grooves, respectively, are recessed sufficiently to accommodate the spines of said connectors.

13. A plantable wall block assembly comprising a plurality of modular wall blocks and a plurality of connectors therefor, each of said wall blocks including a front wall, a rear wall and a pair of opposing side walls, each of said walls including an inside face, an outside face, a top surface and a bottom surface, an opening extending between at least portions of said top and bottom surfaces of said walls and defined by said inside faces thereof, said front and rear walls each having opposed end portions and intermediate portions which are generally parallel to each other, and each of said side walls each having opposed front and rear portions and intermediate portions which are generally parallel to each other and to a wall block vertical central axial plane which is perpendicular to said intermediate portions of said front wall, at least one first connector-receiving slot defined in one of said top and bottom surfaces of said intermediate portions of each of said side walls, and at least two further connector-receiving slots defined in spaced relationship to each other in the other of said top and bottom surfaces, each of said connectors including a spine having opposed top and bottom surfaces and opposed end portions with a connector vertical central axial plane extending between said end portions, at least one first integral protrusion extending from one of said top and bottom surfaces of said spine adapted for engagement in said first connector-receiving slot of one of said wall blocks and at least one further integral protrusion extending from the other of said top and bottom surfaces of said spine adapted for selective engagement in one of said further connector-receiving slots of another of said wall blocks, whereby said connectors are adapted to interconnect wall blocks in superimposed courses of wall blocks with the outside faces of the front walls of wall blocks in superior courses selectively positioned in one of at least two orientations with respect to the outside faces of the front walls of wall blocks in an inferior course of wall blocks which they overly with forward portions of openings in wall blocks in inferior courses of a retaining wall selectively extending forwardly of the outside faces of the front walls of wall blocks in the next superior course to define plant-receiving cavities, each of said first connector-receiving slots being defined in said top surface of said intermediate portion of each of said side walls of said wall blocks and including at least one connector-receiving slot extending transversely to said wall block vertical central axial plane and at least one connector-receiving slot formed by first grooves defined in opposed faces of said intermediate portions of each of said side walls, said first grooves extending at least partially down said side walls from said top surface thereof.

14. A plantable wall block assembly according to claim 13 wherein each of said further connector-receiving slots includes further grooves defined in opposed faces of said intermediate portions of each of said side walls of said wall blocks, said further grooves extending at least partially up said side walls from said bottom surface thereof.

15. A plantable wall block assembly according to claim 14 wherein said first grooves and said further grooves are interconnected to form continuous grooves on opposite faces of said intermediate portions of each of said side walls of said wall blocks.

16. A plantable wall block assembly according to claim 15 wherein the portions of at least one of said top and bottom surfaces of said intermediate portions of said side walls of said wall blocks interconnecting said first grooves and said further grooves, respectively, are recessed sufficiently to accommodate the spines of said connectors.

17. A plantable wall block assembly comprising a plurality of modular wall blocks and a plurality of connectors therefor, each of said wall blocks including a front wall, a rear wall and a pair of opposing side walls, each of said walls including an inside face, an outside face, a top surface and a bottom surface, an opening extending between at least portions of said top and bottom surfaces of said walls and defined by said inside faces thereof, said front and rear walls each having opposed end portions and intermediate portions which are generally parallel to each other, and each of said side walls each having opposed front and rear portions and intermediate portions which are generally parallel to each other and to a wall block vertical central axial plane which is perpendicular to said intermediate portions of said front wall, at least one first connector-receiving slot defined in one of said top and bottom surfaces of said intermediate portions of each of said side walls, and at least two further connector-receiving slots defined in spaced relationship to each other in the other of said top and bottom surfaces, each of said connectors including a spine having opposed top and bottom surfaces and opposed end portions with a connector vertical central axial plane extending between said end portions, at least one first integral protrusion extending from one of said top and bottom surfaces of said spine adapted for engagement in said first connector-receiving slot of one of said wall blocks and at least one further integral protrusion extending from the other of said top and bottom surfaces of said spine adapted for selective engagement in one of said further connector-receiving slots of another of said wall blocks, whereby said connectors are adapted to interconnect wall blocks in superimposed courses of wall blocks with the outside faces of the front walls of wall blocks in superior courses selectively positioned in one of at least two orientations with respect to the outside faces of the front walls of wall blocks in an inferior course of wall blocks which they overly with forward portions of openings in wall blocks in inferior courses of a retaining wall selectively extending forwardly of the outside faces of the front walls of wall blocks in the next superior course to define plant-receiving cavities, further including a shelf underlying only the forward portions of said openings in said wall blocks to retain soil or the like in the plant-receiving cavity.

18. A retaining wall formed from a plurality of superimposed courses of modular wall blocks interconnected by connectors therefor with fill material behind said courses of wall blocks, each of said wall blocks including a front wall, a rear wall and a pair of opposing side walls, each of said walls including an inside face, an outside face, a top surface and a bottom surface, an opening extending between at least portions of said top and bottom surfaces of said walls and defined by said inside faces thereof, said front and rear walls each having opposed end portions and intermediate portions which are generally parallel to each other, and each of said side walls each having opposed front and rear portions and intermediate portions which are generally parallel to each other and to a wall block vertical central axial plane which is perpendicular to said intermediate portions of said front wall, at least one first connector-receiving slot defined in said top surfaces of said intermediate portions of each of said side walls, and at least two further connector-receiving slots defined in spaced relationship to each other in said bottom surfaces thereof, each of said connectors including a spine having opposed top and bottom surfaces and opposed end portions with a connector vertical central axial plane extending between said end portions, at least one first integral protrusion extending from said bottom surface of said spine engaged in said first connector-receiving slot of one of said wall blocks and at least one further integral protrusion extending from said top surface of said spine selectively engaged in one of said further connector-receiving slots of a superimposed wall block, whereby said connectors interconnect wall blocks in superimposed courses of wall blocks with the outside faces of the front walls of wall blocks in superior courses selectively positioned in one of at least two orientations with respect to the outside faces of the front walls of wall blocks in an inferior course of wall blocks which they overly with forward portions of openings in wall blocks in inferior courses of a retaining wall selectively extending forwardly of the outside faces of the front walls of wall blocks in the next superior course to define plant-receiving cavities, and plants planted in at least some of said plant-receiving cavities.

19. A retaining wall according to claim 18 wherein at least certain of said first connector-receiving slots extend transversely to said wall block vertical central axial plane, and said first protrusions on at least certain of said connectors being dimensioned for frictional engagement in said first connector-receiving slots, further including geogrid reinforcing sheet material having end portions defining a multiplicity of spaced apertures, said first protrusions on said selected connectors comprising a plurality of first protrusions spaced from each other and passing through selected apertures of said geogrid sheet material thereby securing said end portions of said geogrid sheet material to selected wall blocks with the remainder of said geogrid sheet material extending rearwardly therefrom to reinforce said fill material behind said wall blocks.

20. A retaining wall according to claim 19 wherein said first connector-receiving slots in intermediate portions of opposed side walls of each wall block are transversely aligned with each other and said spines of said connectors are dimensioned to extend across said wall block with first protrusions thereof extending from opposed end portions of said spine through apertures in said geogrid sheet material and frictionally engaged in said aligned first connector-receiving slots, and with additional first protrusions intermediate said opposed end portions of said spine passing through additional apertures in said geogrid sheet material.

21. A retaining wall formed from a plurality of superimposed courses of modular wall blocks interconnected by connectors therefor with fill material behind said courses of wall blocks, each of said wall blocks including a front wall, a rear wall and a pair of opposing side walls, each of said walls including an inside face, an outside face, a top surface and a bottom surface, an opening extending between at least portions of said top and bottom surfaces of said walls and defined by said inside faces thereof, said front and rear walls each having opposed end portions and intermediate portions which are generally parallel to each other, and each of said side walls each having opposed front and rear portions and intermediate portions which are generally parallel to each other and to a wall block vertical central axial plane which is perpendicular to said intermediate portions of said front wall, at least one first connector-receiving slot defined in said top surfaces of said intermediate portions of each of said side walls, and at least two further connector-receiving slots defined in spaced relationship to each other in said bottom surfaces thereof, each of said connectors including a spine having opposed top and bottom surfaces and opposed end portions with a connector vertical central axial plane extending between said end portions, at least one first integral protrusion extending from said bottom surface of said spine engaged in said first connector-receiving slot of one of said wall blocks and at least one further integral protrusion extending from said top surface of said spine selectively engaged in one of said further connector-receiving slots in a superimposed wall block, whereby said connectors interconnect wall blocks in superimposed courses of wall blocks with the outside faces of the front walls of wall blocks in superior courses selectively positioned in one of at least two orientations with respect to the outside faces of the front walls of wall blocks in an inferior course of wall blocks which they overly with forward portions of openings in wall blocks in inferior courses of a retaining wall selectively extending forwardly of the outside faces of the front walls of wall blocks in the next superior course to define plant-receiving cavities, and plants planted in at least some of said plant-receiving cavities, further including a shelf underlying only the forward portions of said openings in said wall blocks to retain soil or the like in the plant-receiving cavity.

22. A retaining wall formed from a plurality of superimposed courses of modular wall blocks interconnected by connectors therefor with fill material behind said courses of wall blocks, each of said wall blocks including a front wall, a rear wall and a pair of opposing side walls, each of said walls including an inside face, an outside face, a top surface and a bottom surface, an opening extending between at least portions of said top and bottom surfaces of said walls and defined by said inside faces thereof, said front and rear walls each having opposed end portions and intermediate portions which are generally parallel to each other, and each of said side walls each having opposed front and rear portions and intermediate portions which are generally parallel to each other and to a wall block vertical central axial plane which is perpendicular to said intermediate portions of said front wall, at least one first connector-receiving slot defined in said top surfaces of said intermediate portions of each of said side walls, and at least two further connector-receiving slots defined in spaced relationship to each other in said bottom surfaces thereof, each of said connectors including a spine having opposed top and bottom surfaces and opposed end portions with a connector vertical central axial plane extending between said end portions, at least one first integral protrusion extending from said bottom surface of said spine engaged in said first connector-receiving slot of one of said wall blocks and at least one further integral protrusion extending from said top surface of said spine selectively engaged in one of said further connector-receiving slots in a superimposed wall block, whereby said connectors interconnect wall blocks in superimposed courses of wall blocks with the outside faces of the front walls of wall blocks in superior courses selectively positioned in one of at least two orientations with respect to the outside faces of the front walls of wall blocks in an inferior course of wall blocks which they overly with forward portions of openings in wall blocks in inferior courses of a retaining wall selectively extending forwardly of the outside faces of the front walls of wall blocks in the next superior course to define plant-receiving cavities, and plants planted in at least some of said plant-receiving cavities, at least certain of said first connector-receiving slots extending transversely to said wall block vertical central axial plane, and said first protrusions on at least certain of said connectors being dimensioned for frictional engagement in said first connector-receiving slots, further including geogrid reinforcing sheet material having end portions defining a multiplicity of spaced apertures, said first protrusions on said selected connectors comprising a plurality of first protrusions spaced from each other and passing through selected apertures of said geogrid sheet material thereby securing said end portions of said geogrid sheet material to selected wall blocks with the remainder of said geogrid sheet material extending rearwardly therefrom to reinforce said fill material behind said wall blocks, and each of said further connector-receiving slots including grooves defined in opposed faces of said intermediate portions of each of said side walls of said wall blocks, said grooves extending at least partially up said side walls from said bottom surface thereof, each of said further protrusions on said connectors comprising at least one pair of protrusions extending from said top surface of said spine spaced from each other along said connector vertical central axial plane and slidingly received in a selected pair of grooves.

23. A retaining wall formed from a plurality of superimposed courses of modular wall blocks interconnected by connectors therefor with fill material behind said courses of wall blocks, each of said wall blocks including a front wall, a rear wall and a pair of opposing side walls, each of said walls including an inside face, an outside face, a top surface and a bottom surface, an opening extending between at least portions of said top and bottom surfaces of said walls and defined by said inside faces thereof, said front and rear walls each having opposed end portions and intermediate portions which are generally parallel to each other, and each of said side walls each having opposed front and rear portions and intermediate portions which are generally parallel to each other and to a wall block vertical central axial plane which is perpendicular to said intermediate portions of said front wall, at least one first connector-receiving slot defined in said top surfaces of said intermediate portions of each of said side walls, and at least two further connector-receiving slots defined in spaced relationship to each other in said bottom surfaces thereof, each of said connectors including a spine having opposed top and bottom surfaces and opposed end portions with a connector vertical central axial plane extending between said end portions, at least one first integral protrusion extending from said bottom surface of said spine engaged in said first connector-receiving slot of one of said wall blocks and at least one further integral protrusion extending from said top surface of said spine selectively engaged in one of said further connector-receiving slots in a superimposed wall block, whereby said connectors interconnect wall blocks in superimposed courses of wall blocks with the outside faces of the front walls of wall blocks in superior courses selectively positioned in one of at least two orientations with respect to the outside faces of the front walls of wall blocks in an inferior course of wall blocks which they overly with forward portions of openings in wall blocks in inferior courses of a retaining wall selectively extending forwardly of the outside faces of the front walls of wall blocks in the next superior course to define plant-receiving cavities, and plants planted in at least some of said plant-receiving cavities, each of said first connector-receiving slots of said wall blocks including first grooves defined in opposite faces of said intermediate portions of each of said side walls, said first grooves extending at least partially down said side walls from said top surface thereof, and each of said further connector-receiving slots including further grooves defined in opposite faces of said intermediate portions of each of said side walls, said further grooves extending at least partially up said side walls from said bottom surface thereof, each of said first protrusions on said connectors comprising at least one pair of protrusions extending from said bottom surface of said spine spaced from each other along said connector vertical central axial plane and slidingly received in a selected pair of said first grooves, and each of said further protrusions on said connector comprising at least one pair of protrusions extending from said top surface of said spine spaced from each other along said connector vertical axial plane and slidingly received in a selected pair of said further grooves.

24. A retaining wall according to claim 23 wherein each of connectors is generally H-shaped, the pair of protrusions forming said first protrusions being a continuation of the pair of protrusions forming said further protrusions on the opposite surface of the spine of said connector.

25. A retaining wall according to claim 23 wherein said first grooves and said further grooves are interconnected to form continuous grooves on opposite faces of said intermediate portions of each of said side walls of said wall blocks.

26. A retaining wall according to claim 23 wherein the portions of at least one of said top and bottom surfaces of said intermediate portions of said side walls of said wall blocks interconnecting said first grooves and said further grooves, respectively, are recessed sufficiently to accommodate the spines of said connectors.

* * * * *